US006769565B2

(12) United States Patent
Tramontina et al.

(10) Patent No.: US 6,769,565 B2
(45) Date of Patent: Aug. 3, 2004

(54) DISPENSING CARTRIDGE AND SYSTEM

(75) Inventors: Paul Francis Tramontina, Alpharetta, GA (US); Jan Byron Charles Spencer, Bookham (GB); Leonard Wesley Smith, Jr., Roswell, GA (US); Janet Lee Watson, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 103 days.

(21) Appl. No.: 10/026,068

(22) Filed: Dec. 21, 2001

(65) Prior Publication Data

US 2002/0139811 A1 Oct. 3, 2002

Related U.S. Application Data

(60) Provisional application No. 60/258,239, filed on Dec. 26, 2000.

(51) Int. Cl.[7] ..... A47K 10/24

(52) U.S. Cl. ..... 221/45; 221/46; 221/64; 221/197; 221/283; 221/286; 221/287; 221/302

(58) Field of Search ..... 221/45, 46, 64, 221/197, 282, 283, 286, 287, 302

(56) References Cited

U.S. PATENT DOCUMENTS

| | | | |
|---|---|---|---|
| 813,594 | A | 2/1906 | Sexton |
| 1,579,429 | A | 4/1926 | Arms |
| 1,605,231 | A | 11/1926 | Hoberg |
| 2,143,614 | A | 1/1939 | Winter et al. |
| 2,195,437 | A | 4/1940 | West |
| 2,323,395 | A | 7/1943 | Harwood |
| 2,730,267 | A | 1/1956 | Marcalus |
| 2,858,045 | A | 10/1958 | Loeb |
| 3,161,336 | A | 12/1964 | Loescher |
| 3,164,298 | A | 1/1965 | Repko |
| 3,174,644 | A | 3/1965 | Kaltman et al. |
| 3,203,586 | A | 8/1965 | Downham |
| 3,272,385 | A | 9/1966 | Watkins |

(List continued on next page.)

FOREIGN PATENT DOCUMENTS

| | | | |
|---|---|---|---|
| CA | 856616 | | 11/1970 |
| DE | 3144944 | A1 | 5/1983 |
| EP | 0331027 | A1 | 2/1989 |
| EP | 0372781 | A1 | 6/1990 |
| EP | 0419063 | A2 | 3/1991 |
| FR | 2362610 | | 3/1978 |
| FR | 2775579 | | 9/1999 |
| JP | 3-187873 | | 8/1991 |
| WO | 92/10412 | | 6/1992 |
| WO | 95/08491 | | 3/1995 |
| WO | 96/41752 | | 12/1996 |
| WO | 97/20755 | | 6/1997 |
| WO | 97/22528 | | 6/1997 |
| WO | 97/41045 | | 11/1997 |
| WO | 98/22009 | | 5/1998 |
| WO | 98/26702 | | 6/1998 |
| WO | 98/40002 | | 9/1998 |
| WO | 99/30601 | | 6/1999 |

*Primary Examiner*—David H Bollinger
(74) *Attorney, Agent, or Firm*—Douglas H. Tulley, Jr.; Sue C. Watson

(57) ABSTRACT

A dispensing system that includes a housing and a cartridge which is to be inserted into the interior area of the housing. The housing includes a plurality of intersecting exterior sidewalls, a first end wall defining a dispensing throat, a second end wall, and a means for securing a cartridge within the housing. The cartridge includes a flexible bag, a plurality of products compressed within the flexible bag in the dispensing direction, a means for restraining the cartridge within the housing, and a means for releasing the products from the flexible bag.

37 Claims, 6 Drawing Sheets

U.S. PATENT DOCUMENTS

| | | | | |
|---|---|---|---|---|
| 3,343,716 | A | | 9/1967 | Peebles |
| 3,349,959 | A | | 10/1967 | Watkins |
| 3,754,681 | A | | 8/1973 | Slye et al. |
| 3,840,146 | A | | 10/1974 | Bodek |
| 3,970,215 | A | | 7/1976 | McLaren et al. |
| 4,252,236 | A | | 2/1981 | Roccaforte |
| 4,294,389 | A | | 10/1981 | Falk et al. |
| 4,411,374 | A | | 10/1983 | Hotchkiss |
| D275,345 | S | | 9/1984 | Hall |
| 4,678,099 | A | | 7/1987 | Matsui |
| 4,679,703 | A | | 7/1987 | De Luca |
| 4,805,800 | A | | 2/1989 | Nocek et al. |
| 4,840,013 | A | | 6/1989 | Perrella |
| 4,934,535 | A | | 6/1990 | Muckenfuhs et al. |
| 4,938,382 | A | | 7/1990 | Frazier et al. |
| 4,966,286 | A | | 10/1990 | Muckenfuhs |
| 5,002,200 | A | | 3/1991 | Hunt |
| 5,020,670 | A | | 6/1991 | Bedford |
| 5,022,216 | A | | 6/1991 | Muckenfuhs et al. |
| 5,036,978 | A | | 8/1991 | Frank et al. |
| 5,054,619 | A | | 10/1991 | Muckenfuhs |
| 5,065,868 | A | | 11/1991 | Cornelissen et al. |
| 5,100,020 | A | | 3/1992 | Petterson et al. |
| 5,102,007 | A | | 4/1992 | Petterson et al. |
| D332,214 | S | | 1/1993 | Mulder et al. |
| 5,177,934 | A | | 1/1993 | Yamamoto |
| 5,219,092 | A | | 6/1993 | Morand |
| 5,310,057 | A | | 5/1994 | Caldwell et al. |
| 5,316,177 | A | | 5/1994 | Boldt |
| 5,377,837 | A | | 1/1995 | Roussel |
| 5,379,897 | A | | 1/1995 | Muckenfuhs et al. |
| 5,380,094 | A | | 1/1995 | Schmidt et al. |
| 5,415,320 | A | | 5/1995 | North et al. |
| 5,427,245 | A | | 6/1995 | Roussel |
| 5,460,322 | A | | 10/1995 | Carlson et al. |
| 5,462,197 | A | * | 10/1995 | Pound ..... 221/46 |
| 5,507,130 | A | | 4/1996 | Young et al. |
| 5,509,571 | A | | 4/1996 | Weber |
| 5,531,325 | A | * | 7/1996 | Deflander et al. ..... 221/46 X |
| 5,535,887 | A | | 7/1996 | Young et al. |
| 5,540,354 | A | | 7/1996 | Annand |
| 5,622,281 | A | | 4/1997 | Annand |
| 5,642,836 | A | | 7/1997 | Merriweather, Jr. |
| 5,657,900 | A | * | 8/1997 | Scherr ..... 221/45 |
| 5,690,230 | A | | 11/1997 | Griffith |
| 5,722,774 | A | | 3/1998 | Hartz |
| 5,931,339 | A | | 8/1999 | Dodge et al. |
| D414,085 | S | | 9/1999 | Campbell |
| 5,950,863 | A | | 9/1999 | Schutz |
| 6,241,118 | B1 | | 6/2001 | Tramontina |
| 6,378,726 | B1 | | 4/2002 | Chan et al. |
| 6,415,949 | B1 | | 7/2002 | Tramontina |

* cited by examiner

DISPENSING CARTRIDGE AND SYSTEM

RELATED APPLICATIONS

This application claims priority to U.S. Provisional Application Serial No. 60/258,239 filed on Dec. 26, 2000.

BACKGROUND OF THE INVENTION

This invention relates generally to the field of dispensing devices and systems. More particularly, this invention relates to the field of devices and systems for dispensing paper products such as napkins, towels, toilet tissue, etc.

Various types of dispensers for paper products have been developed to provide ready availability of the paper products to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

However, many dispensers are difficult to load, and that difficulty can increase with the size of the dispenser. If paper products are not properly loaded into the dispenser, the paper products may jam as users remove them, thereby preventing further removal of paper products. Also, a person refilling a large dispenser is more likely, due to the larger number of paper products involved, to drop some of the paper products onto a floor. Any dropped paper products are then unsanitary and must be discarded, thereby creating more waste and again defeating the benefits of the larger dispenser.

These difficulties can be partially overcome through use of large dispensers and cartridges containing the paper products. Such a dispenser/cartridge system is disclosed in U.S. patent application Ser. No. 09/156,230. The use of cartridges in such a system simplifies the process of maintaining inventory and refilling empty dispensers.

However, cartridges make refills more expensive. Therefore, there exists a need for a simple and less expensive cartridge that is reliable in use. Also, if a single cartridge is used to refill a dispenser, the cartridge can be quite large. Therefore, there also exists a need for a cartridge which contains a greater number of a given paper product per unit volume of cartridge. Stated another way, there exists a need for a smaller cartridge that still provides the number of products required to fill the dispenser. The smaller cartridge must be easily opened after being inserted in a dispenser.

SUMMARY OF THE INVENTION

In response to the discussed difficulties and problems encountered in the prior art a new cartridge and dispensing system has been discovered.

One embodiment, a dispensing cartridge that is designed to be inserted into the interior area of a housing includes a flexible bag sized to the dimensions of the products contained within the bag. The cartridge also includes a plurality of products compressed within the flexible bag in the dispensing direction and a means for restraining the cartridge within a housing. Additionally, the cartridge includes a means for releasing the products from the flexible bag so that upon release at least a number of the products are ejected from the bag into dispensing position within a housing.

The flexible bag for containing the products may be substantially rectangular. The flexible bag may be constructed from paper or a thermoplastic polymer such as polyethylene. The flexible bag may be formed of a plastic sheet such that the bag has panels with a thickness that may be from about 0.3 to about 15 mils. Desirably, the bag may have panels or walls with a thickness that may be from about 1 to about 7 mils. More desirably, the panels or walls may have a thickness that may be from about 2 to about 3 mils. One mil is 0.001 inch or 0.0254 mm.

The plurality of products compressed within the flexible bag may be a plurality of absorptive products. The products may be napkins, tissues, towels or wipers. The products may be compressed within the cartridge in a direction substantially parallel to their thickness. Desirably, the products may be made of paper. It is contemplated that the products may be paper products compressed to reduce volume prior to packaging and then compressed again within the cartridge.

The means for restraining the cartridge within the housing may include at least one housing hook member attached to a flap attached to the top of the flexible bag. Additionally, the means for restraining the cartridge within the housing may include a flap attached to the top of the flexible bag. The flap may define one or more cartridge mounting holes.

The means for releasing the products from the flexible bag may include a removable product release portion of the flexible bag, removal of the product release portion creating an opening and allowing the plurality of products to expand out of the flexible bag. Additionally, the means for releasing the products from the flexible bag may include a tab attached to the removable product release portion which, when pulled, would allow the removal of the product release portion. The removable product release portion may be defined by a series of perforations in the flexible bag.

In another embodiment of the present invention, a dispensing cartridge is provided for dispensing a plurality of individual paper products from a dispenser housing. The cartridge includes a flexible, substantially rectangular, bag. The flexible bag may be formed of paper, nonwoven materials or plastic films or combinations thereof. For example, the flexible bag may be formed of a plastic sheet such that the bag has panels with a thickness that may be from about 0.3 to about 15 mils. Desirably, the bag may have panels or walls with a thickness that may be from about 1 to about 7 mils. More desirably, the panels or walls may have a thickness that may be from about 2 to about 3 mils. One mil is 0.001 inch or 0.0254 mm.

The bag is sized to the dimensions of the paper products to be loaded in it. Within the flexible bag is a plurality of paper products compressed within the flexible bag in a direction substantially parallel to their thickness.

The embodiment includes a flap attached to the top of the flexible bag. The flap defines one or more cartridge mounting holes by which to restrain the cartridge within a housing.

There is a product release mechanism that includes a removable product release portion of the flexible bag. Removal of the product release portion creates an opening and allows the plurality of products to expand out of the flexible bag so that at least a number of the products are ejected from the bag into dispensing position within a housing. The product release mechanism also includes a tab attached to the removable product release portion which, when pulled, would allow the removal of the product release portion.

The paper products compressed within the flexible bag may be napkins, tissues, towels or wipers.

Another embodiment of the present invention, a dispensing system, includes both a housing and a cartridge.

The housing includes a plurality of intersecting exterior sidewalls defining an interior surface and an interior area within the interior surface for receiving a cartridge. The housing also includes a first end wall intersecting the exterior sidewalls and defining a dispensing throat. Additionally, the housing includes a second end wall intersecting the exterior sidewalls. Moreover, the housing includes a means for securing a cartridge within the housing.

The cartridge, which is to be inserted into the interior area of the housing, includes a flexible bag sized to the dimensions of the products to be loaded in it. The cartridge also includes a plurality of products compressed within the flexible bag in the dispensing direction. Additionally, the cartridge includes a means for restraining the cartridge within the housing and a means for releasing the products from the flexible bag.

The means for securing a cartridge within the housing may include at least one housing hook member attached to the inside of an exterior sidewall or to the inside of the second end wall. Additionally, the means for securing a cartridge within the housing may include at least one housing mounting hole or slot defined by at least one of the exterior sidewalls or by the second end wall.

The means for restraining the cartridge within the housing may include at least one housing hook member attached to a flap attached to the top of the flexible bag. Additionally, the means for restraining the cartridge within the housing may include a flap attached to the top of the flexible bag, the flap defining one or more cartridge mounting holes.

The housing may include one or more protrusions extending from the interior surface on one or more of the exterior sidewalls into the interior area for contacting the cartridge and/or the products. The protrusions extending from the interior surface of the housing may be curved bumpers and/or rib members. If the protrusions are curved bumpers, the curved bumpers may additionally include a plurality of ridges extending across the curved bumpers perpendicular to the dispensing direction. Additionally, the protrusions may be in contact with the first end wall. The protrusions may be rib members arranged to extend from the interior surface of the housing on at least one opposing exterior sidewall and from an end wall in the region around the dispensing throat. In an embodiment, the rib member may contact products that are ejected from the bag and support the products in a dispensing position within the housing.

One or more of the exterior sidewalls may include a door hingedly attached to the housing, the door being openable for insertion of a cartridge of products into the interior area. Additionally, the door may be openable for access to the means for securing a cartridge within the housing and the means for restraining the cartridge within the housing. Moreover, the first end wall may include a door hingedly attached to the housing, the door being openable for insertion of a cartridge of products into the interior area.

The flexible bag for containing the products may be substantially rectangular. The flexible bag may be formed of paper. Alternatively and/or additionally, the flexible bag may be formed of a plastic material such as a sheet so that the bag has panels with a thickness that may be from about 0.3 to about 15 mils. Desirably, the bag may have panels or walls with a thickness that may be from about 1 to about 7 mils. More desirably, the panels or walls may have a thickness that may be from about 2 to about 3 mils.

The cartridge may include removable product access portions, removal of the product access portions creating openings in the cartridge, wherein at least one of the openings is disposed adjacent at least one of the protrusions so that the protrusion extends through the opening to contact the plurality of products. The removable product access portions may be defined by a series of perforations in the flexible bag.

The means for releasing the products from the flexible bag may include a removable product release portion of the flexible bag. Removal of the product release portion creates an opening and allows the plurality of products to expand out of the flexible bag so that at least a number of the products are ejected from the bag into dispensing position within the housing. The removable product release portion may be defined by a series of perforations in the flexible bag. Additionally, the means for releasing the products from the flexible bag may include a tab attached to the removable product release portion which, when pulled, would allow the removal of the product release portion.

The plurality of products compressed within the flexible bag may be a plurality of paper products. The paper products may be napkins, tissues, or towels. The paper products may be compressed within the cartridge in a direction substantially parallel to their thickness.

Additional objects and advantages of the invention will be set forth in part in the following description, or may be obvious from the description, or may be learned through the practice of the invention.

BRIEF DESCRIPTION OF THE DRAWINGS

The present invention will be more fully understood from the following detailed description, taken in conjunction with the accompanying drawings (not to scale), wherein like reference numerals refer to like parts, and in which.

DETAILED DESCRIPTION OF THE INVENTION

Figure 1:
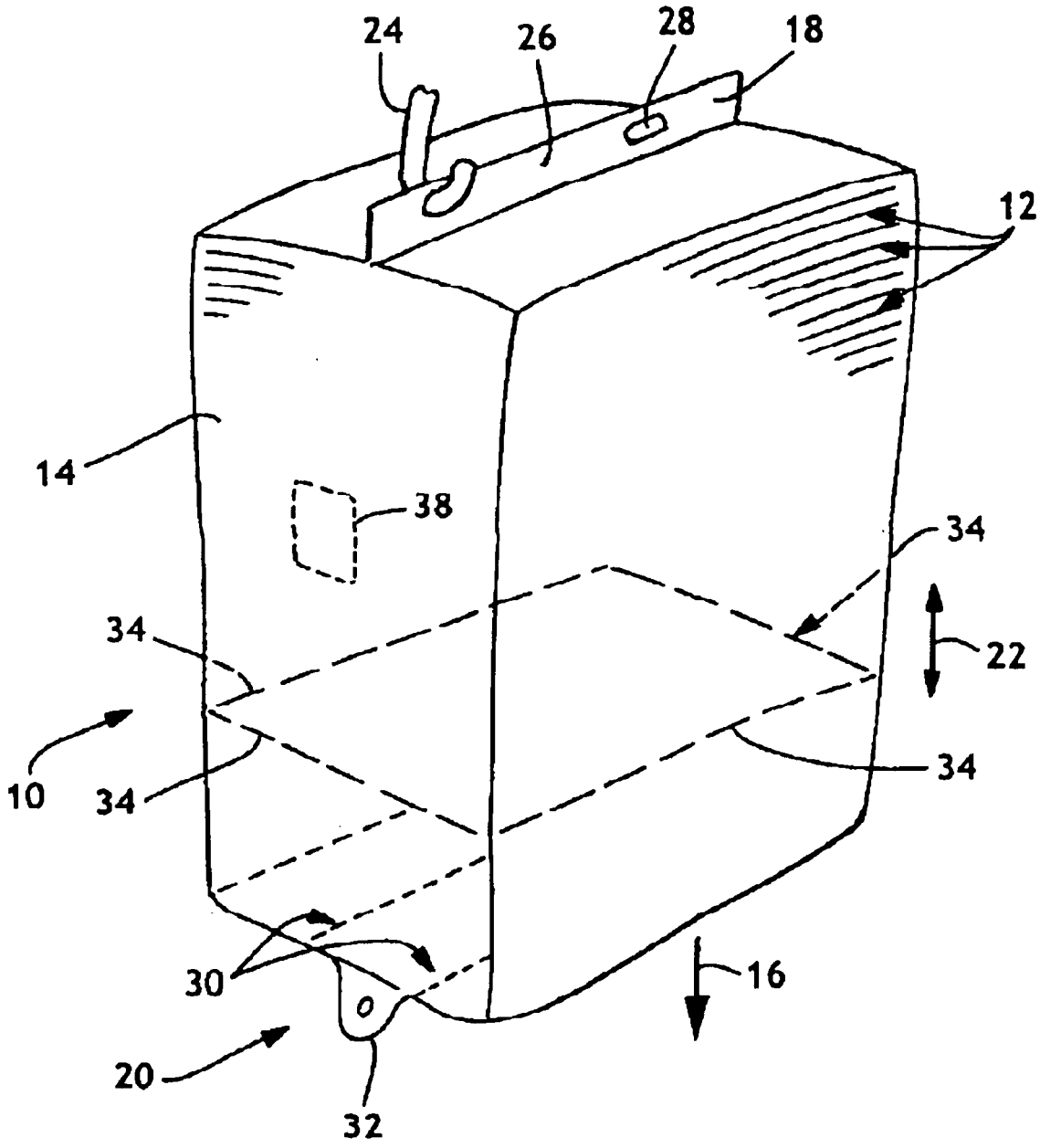
FIG. 1 is a perspective view of an exemplary dispensing cartridge containing compressed products illustrating a means for releasing the products from the flexible bag.

Reference will now be made in detail to various embodiments of the invention, one or more examples of which are illustrated in the drawings (not necessarily to scale). Each example is provided by way of explanation of the invention and not meant as a limitation of the invention. For example, features illustrated or described as part of one embodiment or figure can be used on another embodiment or figure to yield yet another embodiment. The present invention includes such modifications and variations.

As broadly embodied in FIG. 1, a first embodiment of the new dispensing cartridge 10 is disclosed for dispensing products 12.

The dispensing cartridge 10, which is to be inserted into the interior area of a housing, includes a flexible bag 14 sized to the dimensions of the products 12 to be loaded in it. The term "bag" refers to flexible sack or pouch-like container that is used to hold items. The exterior portions of the bag may be stressed or under tension to hold products within the bag in a compressed condition. The flexible bag may be configured to present or more panels or faces formed by the flexible material being stressed or tensioned over the products within the bag. The dispensing cartridge 10 also includes a plurality of products 12 compressed within the flexible bag 14 in the dispensing direction 16. Additionally, the dispensing cartridge 10 includes a restraining means 18 for restraining or holding the cartridge in place within a housing. Finally, the dispensing cartridge 10 includes a releasing means 20 for releasing or discharging the products from the flexible bag so that upon release or discharge at least a number of the compressed products 12 are ejected from the bag 14 into dispensing position within a housing.

The flexible bag 14 for containing the products 12 may be substantially rectangular. The flexible bag 14 may be constructed from a thermoplastic polymer such as polyethylene. The flexible bag 14 may have a thickness of from about 0.3 mils to about 15 mils. The flexible bag 14 is desirably made of plastic film, but may be made of any other suitable material within the scope of the invention, including paper, nonwoven webs or the like. Desirably, the inside surface of the flexible bag 14 will have a low coefficient of friction to facilitate the process of ejecting the products 12 from the bag as well as subsequent dispensing. The flexible bag 14 may have reinforcing components (e.g., additional plastic, paper, cardboard, paperboard or the like) on one or more sides to provide additional rigidity and strength to areas of the bag 14 which may be exposed in a housing which is not completely enclosed. Alternatively and/or additionally, the flexible bag 14 may include reinforcing components on one or more ends.

The plurality of products 12 compressed within the flexible bag 14 may be a plurality of paper products. The paper products may be napkins, tissues, towels, wipers or any other similar material. The paper products may be compressed within the dispensing cartridge 10 in a direction substantially parallel to their thickness 22. Desirably, paper products 12 contained within dispensing cartridge 10 are interfolded or tab interfolded to provide metered feeding of individual napkins one at a time. However, the present invention does not require the use of interfolded paper products.

It is also contemplated that the products 12 could be absorbent products such as diapers, incontinence products, or feminine care products. Any product 12 which can be compressed and which, upon release of the compressive force, will recover a significant portion of its original thickness would fall within the scope of the present invention.

The means for restraining the dispensing cartridge within a housing 18 may be by either a mechanical or adhesive means or combinations thereof. The means for restraining the dispensing cartridge within a housing 18 may include at least one cartridge hook member 24 attached to a flap 26 attached to the top of the flexible bag 14.

Additionally, the means for restraining the dispensing cartridge within a housing 18 may include a flap 26 attached to the top of the flexible bag 14. The flap 26 may define one or more cartridge mounting holes 28. Other mechanical fasteners that may be used include hook and loop fasteners (e.g., Velcro® hook and loop fasteners), eyes and hooks, snaps, clips, elastic bands, strings, rods, and magnetic strips.

Alternatively, the means for restraining the dispensing cartridge within a housing 18 may be by an adhesive seal used to restrain the cartridge within a housing. Persons of skill in the art may readily adapt conventional adhesives and adhesive joining techniques to this application.

Desirably, the adhesive may be a pressure sensitive adhesive layer in the form of at least one strip of adhesive running along the length of at least one side of the flexible bag. One way to utilize pressure sensitive adhesives is to apply them in a strip such as is used in self-sealing envelopes and the like. The adhesive must be selected to provide sufficient adhesion to the reciprocal surface of the housing into which the cartridge is to be inserted. The level of adhesion may be varied and adjusted greatly. It is desirable for the adhesive to provide a level of adhesion that may be great enough that a cartridge inserted in a housing will remain attached to the housing until the cartridge has been depleted of the entirety of its products. Insufficient adhesion allowing the cartridge to collapse within a housing will result in increased difficulty removing products from the housing due to interference from the cartridge. The length and width of the adhesive strip should be selected to maintain this sufficient level of adhesion.

The means for releasing the products from the flexible bag 20 may include a removable product release portion 30 of the flexible bag 14, removal of the product release portion 30 creating an opening and allowing the plurality of products 12 to expand out of the flexible bag 14. Additionally, the means for releasing the products from the flexible bag 20 may include a tab 32 attached to the removable product release portion 30 which, when pulled, would allow the removal of the product release portion 30. The removable product release portion 30 may be defined by a series of perforations 34 in the flexible bag 14.

In another embodiment of the present invention, a dispensing cartridge 10 is provided for dispensing a plurality of individual paper products 12 from a dispenser housing. The dispensing cartridge 10 includes a flexible, substantially rectangular, plastic bag 14 having a thickness of from about 0.3 mils to about 15 mils. The bag 14 is sized to the dimensions of the paper products 12 to be loaded in it. That is, the flexible bag is sized to the dimensions of the products contained within the bag. Within the flexible bag 14 is a plurality of paper products 12 compressed in a direction substantially parallel to their thickness 22.

The embodiment includes a flap 26 attached to the top of the flexible bag 14. The flap 26 defines one or more cartridge mounting holes 28 by which to restrain the dispensing cartridge 10 within a housing.

There is a product release mechanism 36 that includes a removable product release portion 30. Removal of the product release portion 30 creates an opening and allows the plurality of paper products 12 to expand out of the flexible bag 14 so that at least a number of the products 12 are ejected from the bag 14 into dispensing position within a housing. The product release mechanism 36 also includes a tab 32 attached to the removable product release portion 30 which, when pulled, would allow the removal of the product release portion 30.

The paper products 12 compressed within the flexible bag 14 may be napkins, tissues, towels, or any other similar material. Desirably, paper products 12 contained within the cartridge 10 are interfolded or tab interfolded to provide metered feeding of individual paper products 12 one at a time. However, the present invention does not require the use of interfolded paper products.

As broadly embodied in FIGS. 2–6, a new dispensing system 40 is disclosed for dispensing products 12. The new dispensing system 40 includes a housing 42 and a cartridge 10 containing a plurality of products compressed in a dispensing direction as shown in FIG. 1.

The housing 42 includes a plurality of intersecting exterior sidewalls 44 defining an interior surface 46 and an interior area 48 within the interior surface 46 for receiving a cartridge 10. The housing includes a back wall 43 which may be a solid wall or may be partially or completely open. The housing 42 also includes a first end wall 50 intersecting the exterior sidewalls 44 and defining a dispensing throat 52. Additionally, the housing 42 includes a second end wall 54 intersecting the exterior sidewalls 44. The housing may optionally include front walls 55 that intersect with the exterior sidewalls 44 and one or more of the end walls 50 and/or 54. Moreover, the housing 42 includes a means for securing a cartridge within the housing 56.

The exterior sidewalls 44, first end wall 50, and second end wall 54 may each, if desired, be made of two planar portions(e.g., a double wall construction). Such construction strengthens the housing 42 and is useful in locations where the housing 42 might be vandalized. The outer portions of the exterior sidewalls 44 help withstand any blow or impact to the housing 42 to prevent destruction of the housing 42, removal of the housing 42 from its mounting, or removal of products 12 from the housing 42.

The cartridge 10, which is to be inserted into the interior area 48 of the housing 42, includes a flexible bag 14 sized to the dimensions of the products 12 to be loaded in it. The cartridge 10 also includes a plurality of products 12 compressed within the flexible bag 14 in the dispensing direction 16. Additionally, the cartridge 10 includes a means for restraining the cartridge within the housing 64 and a means for releasing the products from the flexible bag 20.

The means for securing a cartridge within the housing 56 may include at least one housing hook member 58 attached to the inside of an exterior sidewall 44 or to the inside of the second end wall 54. Additionally, the means for securing a cartridge within the housing 56 may include at least one housing mounting hole 60 or slot 62 defined by at least one of the exterior sidewalls 44 or by the second end wall 54.

Figure 2:
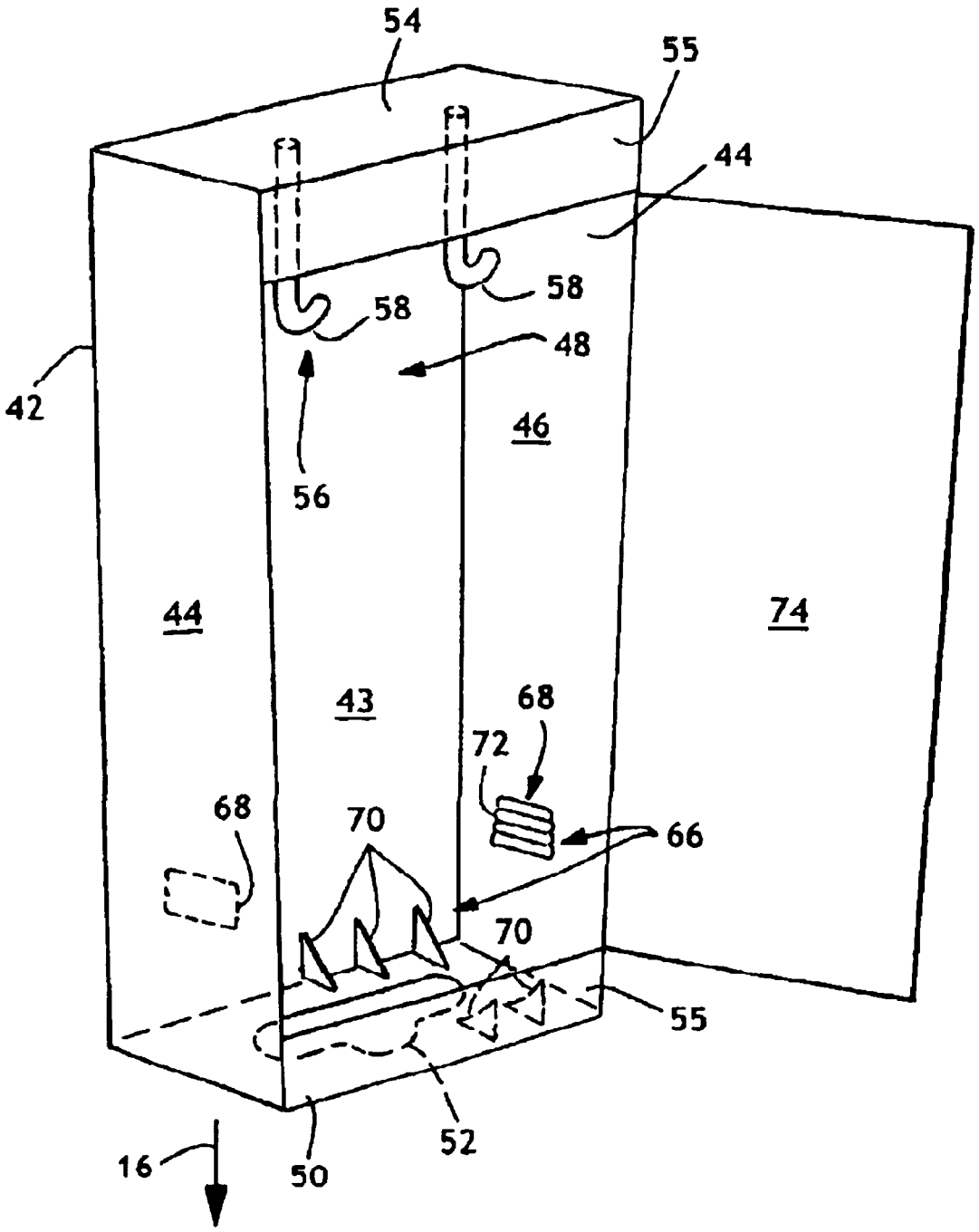
FIG. 2 is perspective view of an exemplary dispensing system for dispensing paper products with a hinged door on one of the sides.
Figure 2A:
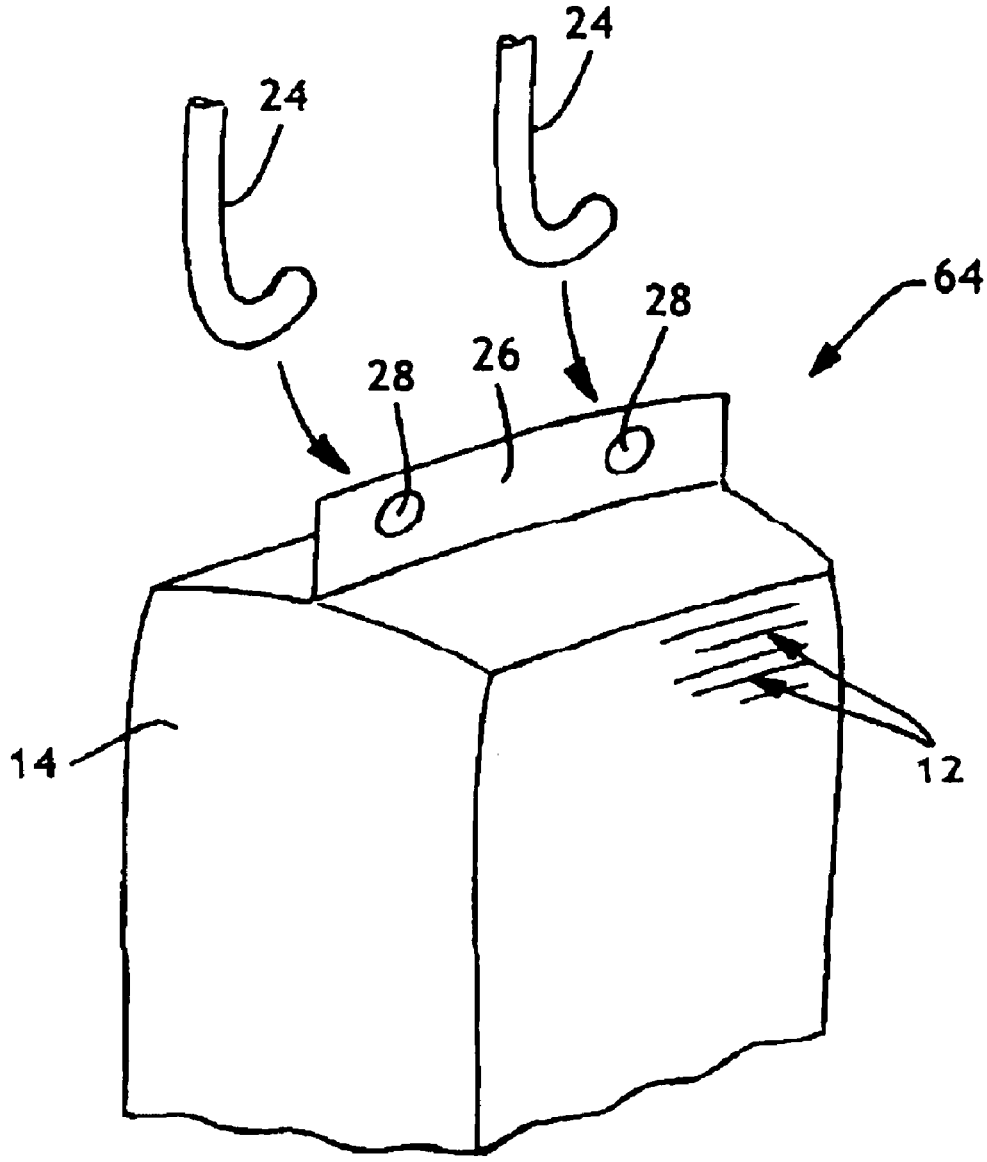
FIG. 2A is perspective view of a detail of an exemplary dispensing system for dispensing paper products.
Figure 3:
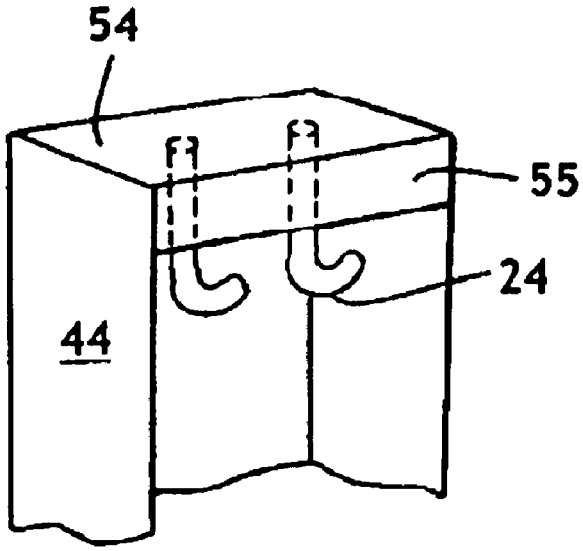
FIG. 3 is a perspective view of an exemplary housing wherein the means for securing a cartridge within the housing includes housing hook members attached to an exterior sidewall.
Figure 4:
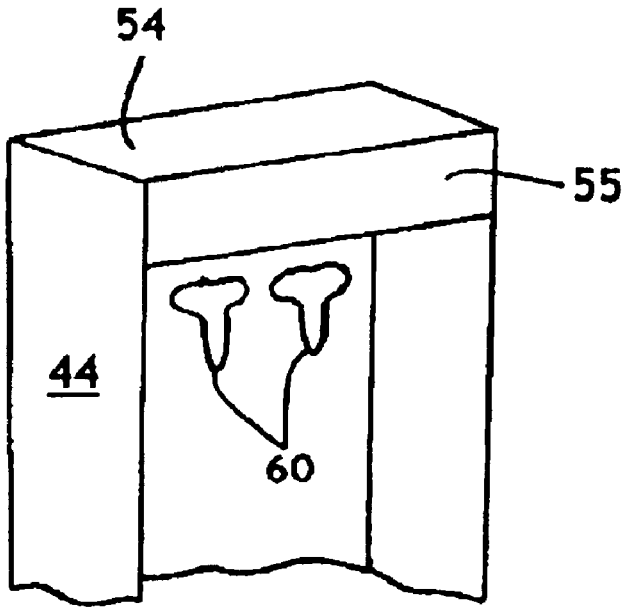
FIG. 4 is a perspective view of an exemplary housing wherein the means for securing a cartridge within the housing includes housing mounting holes defined by an exterior sidewall.
Figure 5:
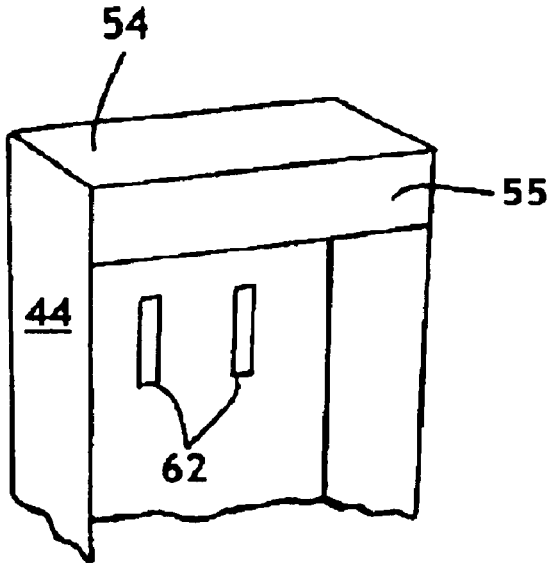
FIG. 5 is a perspective view of an exemplary housing wherein the means for securing a cartridge within the housing includes slots defined by an exterior sidewall.
Figure 6:
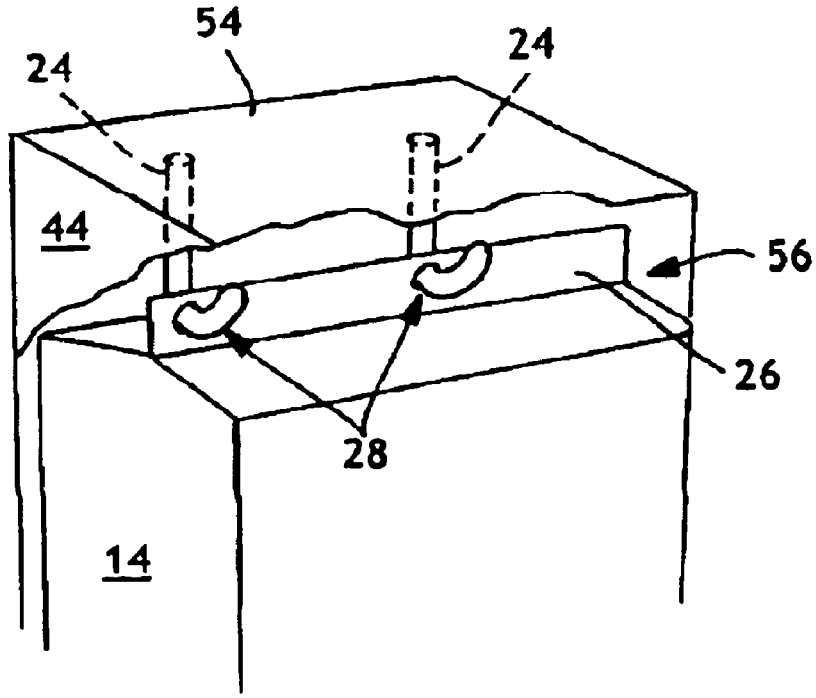
FIG. 6 is a perspective view of an exemplary cartridge wherein the means for restraining the cartridge within the housing includes cartridge hook members attached to a flap.

The means for restraining the dispensing cartridge within the housing 64 may be by either a mechanical or adhesive means or combinations thereof. The means for restraining the dispensing cartridge within the housing 64 may include at least one cartridge hook member 58 attached to a flap 26 attached to the top of the flexible bag 14. Additionally, the means for restraining the dispensing cartridge within the housing 64 may include a flap 26 attached to the top of the flexible bag 14. The flap 26 may define one or more cartridge mounting holes 28. The hook member 58 is inserted through the mounting holes 28 in the flap 26 attached to the flexible bag 14 as shown by the arrow in FIG. 2A. A detail of the hooks 58 is illustrated in FIG. 3. Other mechanical fasteners that may be used include hook and loop fasteners (e.g., Velcro® hook and loop fasteners), eyes and hooks, snaps, clips, elastic bands, strings, rods, and magnetic strips.

Alternatively, the means for restraining the dispensing cartridge within the housing 64 may be by an adhesive seal used to restrain the cartridge within the housing 42. Persons of skill in the art may readily adapt conventional adhesives and adhesive joining techniques to this application.

Desirably, the adhesive may be a pressure sensitive adhesive layer in the form of at least one strip of adhesive running along the length of at least one side of the flexible bag. One way to utilize pressure sensitive adhesives is to apply them in a strip such as is used in self-sealing envelopes and the like. The adhesive must be selected to provide sufficient adhesion to the reciprocal surface of the housing into which the cartridge is to be inserted. The level of adhesion may be varied and adjusted greatly. It is desirable for the adhesive to provide a level of adhesion that may be great enough that a dispensing cartridge 10 inserted in the housing 42 will remain attached to the housing until the cartridge has been depleted of the entirety of its products. Insufficient adhesion allowing the dispensing cartridge 10 to collapse within the housing 42 will result in increased difficulty removing products from the housing 42 due to interference from the dispensing cartridge 10. The length and width of the adhesive strip should be selected to maintain this sufficient level of adhesion.

The housing 42 may include one or more protrusions 66 extending from the interior surface 46 on one or more of the exterior sidewalls 44 into the interior area 48 for contacting the cartridge 10. The protrusions 66 extending from the interior surface 46 of the housing 42 may be curved bumpers 68 and/or rib members 70. If the protrusions 66 are curved bumpers 68, the curved bumpers 68 may additionally include a plurality of ridges 72 extending across the curved bumpers 68 perpendicular to the dispensing direction 16.

By extending into the interior area 48 to contact the cartridge 10 and/or products 12, the curved bumpers 68 impede the movement of products 12 toward the dispensing throat 52, but do not prohibit such movement. The ridges 72 allow numerous products 12 to be contacted by an individual bumper 68 and allow for a smoother movement of products 12 through the housing 42. In embodiments wherein gravity urges the products 12 in the dispensing direction 16, protrusions 66 also support products 12 against the force of gravity. Protrusions 66 therefore reduce the gravitational force of the bottom of the products 12 on the dispensing throat 52, thereby making it easier for a user to remove individual products from the dispensing throat 52.

Additionally, the protrusions may be rib members 70 that extend from at least one side wall 44 or front wall 55 (for convenience, the front wall 55 may be referred to as a side wall 44) and may further extend from or contact an end wall (i.e., the first end wall 50) in an area near the dispensing throat 52. Generally speaking, the rib members 70 may be arranged to extend from the interior surface 46 of the housing 42 to contact products that are ejected from the bag or discharged from the bag during normal dispensing operation and support the products in a dispensing position within the housing.

One or more of the exterior sidewalls 44 may include a door 74 hingedly attached to the housing 42, the door 74 being openable for insertion of a cartridge 10 of products 12 into the interior area 48. Additionally, the door 74 may be openable for access to the means for securing a cartridge within the housing 56 and the means for restraining the cartridge within the housing 64. The door 74 may form all of or only a portion of an exterior sidewall 44. Moreover, the first end wall 50 may include a door 74 hingedly attached to the housing 42, the door 74 being openable for insertion of a cartridge 10 of products 12 into the interior area 48.

Figure 7:
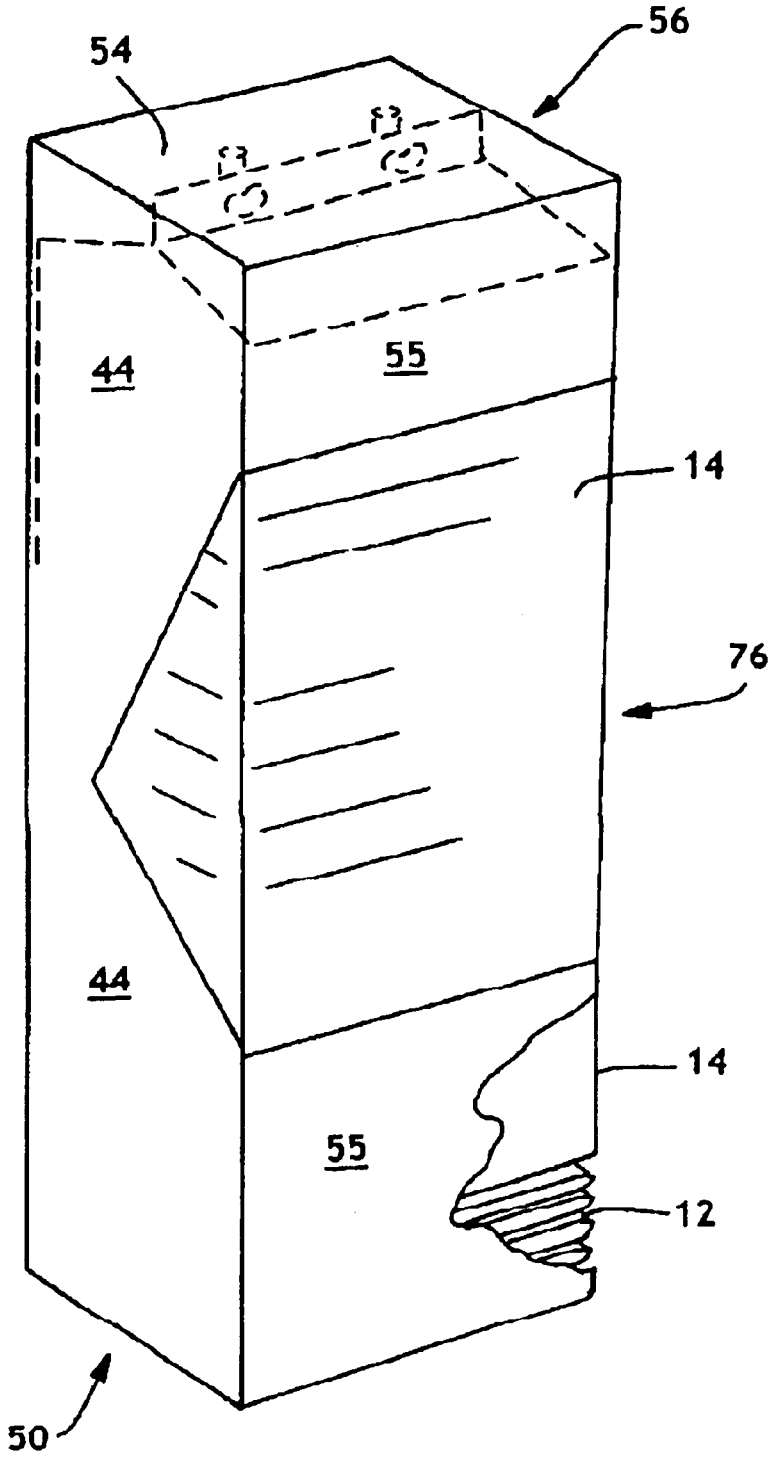
FIG. 7 is a perspective view of an exemplary housing depicting an opening in a sidewall of the housing for insertion of a dispensing cartridge.

As depicted in FIG. 7, one or more of the exterior sidewalls 44, the first end wall 50, or the second end wall 54 (and optionally a front face 55) may define at least one opening 76 that may be for insertion of a cartridge of products into the interior area 48. Another opening may be provided for access to the means for securing a cartridge within the housing 56 or the means for restraining the cartridge within the housing. This second opening may be on the back face or back wall of the housing or may be located on a front wall or sidewall of the housing.

The housing 42 may be made of injection-molded plastic such as polyethylene or nylon. However, other suitable materials, such as other plastics, wood, composites, pressboard, heavyweight cardboard or paperboards, metals, ceramics or combinations thereof, may be provided for any or all of the parts of the housing 42. The curved bumpers 68 and rib members 70 are desirably formed integral with the housing 42. However, the curved bumpers 68 and rib members 70 may be formed separately from the housing 42 and attached later. Also, the curved bumpers 68 and rib members 70 may be made of different material from the housing 42 if desired. For example, the curved bumpers 68 and/or rib members 70 may be made of a more resilient material than the materials described above, such as an elastomer or rubber.

The dispensing throat 52 may have many shapes within the scope of the present invention. Desirably, the dispensing throat 52 provides easy access for a user and metered delivery of individual products 12.

Desirably, paper products 12 contained within cartridge 10 are interfolded or tab interfolded to provide metered feeding of individual napkins one at a time. However, the present invention does not require the use of interfolded paper products.

It is also contemplated that the products 12 could be absorbent products such as diapers, incontinence products, or feminine care products. Any product 12 which can be compressed and which, upon release of the compressive force, will recover a significant portion of its original thickness would fall within the scope of the present invention.

The flexible bag 14 for containing the products 12 may be substantially rectangular. The flexible bag 14 may be constructed from a thermoplastic polymer such as polyethylene. The flexible bag 14 may have a thickness of from about 0.3 mils to about 15 mils, desirably from about 1 to about 7 mils, or more desirably from about 2 to about 3 mils. The flexible bag 14 is desirably made of plastic film, but may be made of any other suitable material within the scope of the invention, including paper. Desirably, the inside surface of the flexible bag 14 will have a low coefficient of friction to facilitate the process of ejecting the products 12 from the bag. Additionally, the flexible bag 14 may have reinforcing components on one or more sides to provide additional rigidity and strength to areas of the bag 14 which may be exposed in a housing which is not completely enclosed.

The cartridge 10 may include removable product access portions 38. Removal of the product access portions 38 creates openings in the cartridge 10, wherein at least one of the openings is disposed adjacent at least one of the protrusions 66 so that the protrusion 66 extends through the opening to contact the plurality of products 12. The removable product access portions 38 may be defined by a series of perforations in the flexible bag 14. It is contemplated, however, that protrusions 66 may still function as desired even in the absence of removable product access portions 38 due to the flexibility of the bag 14.

In one aspect of the present invention, the use of the dispensing cartridge 10 containing compressed products 12 allows protrusions 66, bumpers 68 and/or ribs 70 to be positioned closer to the dispensing throat 52. This is a feature that is desired for optimum dispensing and metering of the products 12. Conventional cartridges that are not made of flexible materials require removable product access portions through which the protrusions extend to contact the products within the cartridge. In conventional cartridges made of rigid cardboard, conventional manufacturing techniques make it difficult to manufacture the product access portions near the dispensing end of the cartridge as would be necessary to put the protrusions 66, bumpers 68 and/or ribs 70 closer to the dispensing throat 52. The present invention does not require product access portions because the protrusions 66 and/or bumpers 68 can be placed in the area of the housing 42 above the dispensing throat 52, but below the lowest portion of the dispensing cartridge 10. For example, the lowest portion of the dispensing cartridge 10 is shown in cut-away view in at the bottom portion of FIG. 7. Then when the means for releasing the products from the flexible bag 20 is activated, the products 12 expand out of the flexible bag 20 and engage the protrusions 66 and/or bumpers 68 located below the dispensing cartridge.

The means for releasing the products from the flexible bag 20 may include a removable product release portion 30 of the flexible bag 14, removal of the product release portion 30 creating an opening and allowing the plurality of products 12 to expand out of the flexible bag 14. Additionally, the means for releasing the products from the flexible bag 20 may include a tab 32 attached to the removable product release portion 30 which, when pulled, would allow the removal of the product release portion 30.

The plurality of products 12 compressed within the flexible bag 14 may be a plurality of paper products. The paper products may be napkins, tissues, towels, or any other similar material. The paper products may be compressed within the cartridge 10 in a direction substantially parallel to their thickness 22.

While the invention has been described in detail with respect to specific embodiments thereof, it will be appreciated that those skilled in the art, upon attaining an understanding of the foregoing may readily conceive of alterations to, variations of and equivalents to these embodiments. Accordingly, the scope of the present invention should be assessed as that of the appended claims and any equivalents thereto.

We claim:

1. A dispensing cartridge for use in a dispenser housing comprising:

a flexible bag, the bag being sized to the dimensions of products contained within the bag, a plurality of products compressed within the flexible bag in a dispensing direction, a means for restraining the cartridge within a housing, and a means for releasing the products from the flexible bag so that upon release at least a number of the products are completely ejected from the bags, said means including a removable portion including a tab which extends outward a distance away from the bag, the tab configured to be pulled to remove the removable portion such that the number of products are completely ejected from the bog.

2. The dispensing cartridge of claim 1 wherein the flexible bag is substantially rectangular.

3. The dispensing cartridge of claim 1 wherein the flexible bag is constructed from a thermo-plastic polymer.

4. The dispensing cartridge of claim 1 wherein the flexible bag is formed of panels having a thickness of from about 0.3 mil to about 15 mil.

5. The dispensing cartridge of claim 1 wherein the plurality of products compressed within the flexible bag is a plurality of paper products.

6. The dispensing cartridge of claim 5 wherein the paper products are selected from napkins, tissues and towels.

7. The dispensing cartridge of claim 5 wherein the paper products are compressed within the cartridge in a direction substantially parallel to their thickness.

8. The dispensing cartridge of claim 1 wherein the means for restraining the cartridge comprises at least one cartridge hook member attached to a flap attached to the top of the flexible bag.

9. The dispensing cartridge of claim 1 wherein the means for restraining the cartridge comprises a flap attached to the top of the flexible bag, the flap defining one or more cartridge mounting holes.

10. The dispensing cartridge of claim 1 wherein the removable product release portion is defined by a series of perforations in the flexible bag.

11. A dispenser cartridge for dispensing individual paper products from a dispenser housing, the dispenser cartridge comprising:

a flexible, substantially rectangular bag formed of material having a thickness of from about 0.3 mil to about 1.5 mil, the bag being sized to the dimensions of the paper products contained within the bag, a plurality of interfolded paper products compressed within the flexible bag in a direction substantially parallel to their thickness, flap attached to the top of the flexible bag, the flap defining one or more cartridge mounting holes, by which to restrain the cartridge within a housing, a product release mechanism comprising:

a removable product release portion, removal of the product release portion creating an opening and allowing the plurality of products to expand out of the flexible bag so that at least a number of the products are completely ejected from the bag, and, a tab attached to and extending a distance away from the removable product release portion which, when pulled, would allow the removal of the product release portion such that the number of the products are completely elected from the bag, and, removable product access portions, defined by a series of perforations, removal of the product access portions creating openings in the cartridge.

12. The dispensing cartridge of claim 11 wherein the paper products that are compressed within the flexible bag are napkins, tissues, or towels.

13. A dispensing system comprising:

a housing comprising:

a plurality of intersecting exterior sidewalls defining an interior surface and an interior area within the interior surface for receiving a cartridge, a first end wall intersecting the exterior sidewalls and defining a dispensing throat, a second end wall intersecting the exterior sidewalls, and, a means for securing a cartridge within the housing, and, a cartridge for insertion into the interior area, the cartridge comprising:

a flexible bag, the bag being sized to the dimensions of the products contained within the bag, a plurality of products compressed within the flexible bag in the dispensing direction, a means for restraining the cartridge within the housing, and, a means for releasing the products from the flexible bag so that upon release at least a number of the products are ejected from the bag into dispensing position within the housing.

14. The dispensing system of claim 13 wherein the means for securing a cartridge within the housing comprises at least one housing hook member attached to the inside of an exterior sidewall or to the inside of the second end wail.

15. The dispensing system of claim 13 wherein the means for securing a cartridge within the housing comprises at least one housing mounting hole or slot defined by at least one of the exterior sidewalls or by the second end wall.

16. The dispensing system of claim 13 wherein the means for restraining the cartridge within the housing comprises at least one cartridge hook member attached to a flap attached to the top of the flexible bag.

17. The dispensing system of claim 13 wherein the means for restraining the cartridge within the housing comprises a flap attached to the top of the flexible bag, the flap defining one or more cartridge mounting holes.

18. The dispensing system of claim 13 further comprising one or more protrusions extending from the interior surface on one or more of the exterior sidewalls into the interior area.

19. The dispensing system of claim 18 wherein the protrusions include curved bumpers for contacting the cartridge.

20. The dispensing system of claim 19 wherein the curved bumpers include a plurality of ridges extending across the curved bumpers perpendicular to the dispensing direction.

21. The dispensing system of claim 18 wherein the protrusions are in contact with the first end wall.

22. The dispensing system of claim 18 wherein the protrusions are rib members.

23. The dispensing system of claim 22 wherein the rib members extend interior surface of the housing on two opposing exterior sidewalls into the interior area for contacting the cartridge.

24. The dispensing system of claim 22 wherein the rib members extend from an interior surface of at least one sidewall and from an end wall around the dispensing throat.

25. The dispensing system of claim 24 wherein the rib members contact products that are ejected from the bag and support the products in a dispensing position within the housing.

26. The dispensing system of claim 18 wherein the cartridge includes removable product access portions, removal of the product access portions creating openings in the cartridge, wherein at least one of the openings is disposed adjacent at least one of the protrusions so that the protrusion extends through the opening to contact the plurality of products.

27. The dispensing system of claim 26 wherein the removable product access portions are defined by a series of perforations in the flexible bag.

28. The dispensing system of claim 13 wherein one or more of the exterior sidewalls further comprises a door hingedly attached to the housing, the door being openable for insertion of a cartridge of products into the interior area.

29. The dispensing system of claim 13 wherein one or more of the exterior sidewalls further comprises a door hingedly attached to the housing, the door being openable for access to the means for securing a cartridge within the housing and the means for restraining the cartridge within the housing.

30. The dispensing system of claim 13 wherein the first end wall further comprises a door hingedly attached to the housing, the door being openable for insertion of a cartridge of products into the interior area.

31. The dispensing system of claim 13 wherein the flexible bag is substantially rectangular.

32. The dispensing system of claim 13 wherein the flexible bag is constructed from a thermo-plastic polymer.

33. The dispensing system of claim 13 wherein the flexible bag has a thickness of from about 0.3 mils to about 15 mils.

34. The dispensing system of claim 13 wherein the means for releasing the products from the flexible bag comprises:

a removable product release portion, removal of the product release portion creating an opening and allowing the plurality of products to expand out of the flexible bag, a tab attached to the removable product release portion which, when pulled, would allow the removal of the product release portion.

35. The dispensing system of claim 13 wherein the plurality of products compressed within the flexible bag is a plurality of paper products.

36. The dispensing system of claim 35 wherein the paper products are napkins, tissues, or towels.

37. The dispensing system of claim 35 wherein the paper products are compressed within the cartridge in a direction substantially parallel to their thickness.

* * * * *

UNITED STATES PATENT AND TRADEMARK OFFICE

CERTIFICATE OF CORRECTION

PATENT NO. : 6,769,565 B2
DATED : August 3, 2004
INVENTOR(S) : Tramontina et al.

It is certified that error appears in the above-identified patent and that said Letters Patent is hereby corrected as shown below:

Column 10,
Line 64, “bags” should read -- bag --;

Column 11,
Line 2, “bog” should read -- bag. --;
Line 33, “1.5” should read -- 15 --.

Signed and Sealed this

Sixteenth Day of August, 2005

JON W. DUDAS
*Director of the United States Patent and Trademark Office*